US006901637B2

(12) United States Patent
Machacek

(10) Patent No.: US 6,901,637 B2
(45) Date of Patent: Jun. 7, 2005

(54) ZIPPER WITH PRE-ACTIVATED PEEL-SEAL

(75) Inventor: Zdenek Machacek, Nanuet, NY (US)

(73) Assignee: Illinois Tool Works Inc., Glenview, IL (US)

( * ) Notice: Subject to any disclaimer, the term of this patent is extended or adjusted under 35 U.S.C. 154(b) by 422 days.

(21) Appl. No.: 10/034,064

(22) Filed: Dec. 20, 2001

(65) Prior Publication Data

US 2003/0118253 A1 Jun. 26, 2003

Related U.S. Application Data

(63) Continuation-in-part of application No. 09/969,736, filed on Oct. 3, 2001, now Pat. No. 6,595,690.

(51) Int. Cl.[7] ..... A44B 19/00; B65D 33/16

(52) U.S. Cl. ..... 24/399; 24/30.5 R; 24/384; 24/400; 24/585.12; 383/63; 383/64

(58) Field of Search ..... 24/399, 400, 384, 24/30.5 R, 585.12; 383/63, 64, 65

(56) References Cited

U.S. PATENT DOCUMENTS

| | | | | |
|---|---|---|---|---|
| 4,782,951 A | | 11/1988 | Griesbach et al. | |
| 4,786,190 A | | 11/1988 | Van Erden | |
| 4,823,961 A | | 4/1989 | Griesbach et al. | |
| 4,878,763 A | * | 11/1989 | Ausnit | 383/65 |
| 4,925,316 A | | 5/1990 | Van Erden et al. | |
| 5,005,707 A | | 4/1991 | Hustad et al. | |
| 5,014,856 A | | 5/1991 | Griesbach et al. | |
| 5,050,736 A | | 9/1991 | Griesbach et al. | |
| 5,107,658 A | | 4/1992 | Hustad et al. | |
| 5,672,009 A | * | 9/1997 | Malin | 383/63 |
| 6,047,450 A | * | 4/2000 | Machacek et al. | 24/399 |
| 6,273,607 B1 | * | 8/2001 | Buchman | 383/64 |
| 6,327,754 B1 | * | 12/2001 | Belmont et al. | 24/400 |
| 6,378,177 B1 | * | 4/2002 | Athans et al. | 383/63 |
| 6,481,890 B1 | * | 11/2002 | VandenHeuvel | 383/64 |
| 6,499,878 B1 | * | 12/2002 | Dobreski et al. | 383/5 |
| 6,624,130 B2 | * | 9/2003 | Giblin et al. | 383/38 |

FOREIGN PATENT DOCUMENTS

EP 0 951 989 A1 10/1999

* cited by examiner

*Primary Examiner*—Victor Sakran
(74) *Attorney, Agent, or Firm*—Pitney Hardin LLP

(57) ABSTRACT

A reclosable fastener assembly (10) for use in the manufacture of a plastic bag (30). The fastener assembly (10) includes a zipper (18) with a seal feature on a web flange (24) extending from an interlocking member (26) of a profile (28) of the zipper (18). The web flange (24) is bent at a lower portion of the web flange (24) upward to the interlocking member (26). At the lower portion, an interior face (32) of the web flange (24) is sealed to an opposite interior face (33) to form a flange seal (31). The bend (35) of the lower portion includes a weakness area (34) which, in concert with the flange seal (31), acts as a barrier and a tamper-evident feature. After the flange seal (31) is initially torn open, the weakness area (34) may be torn open to access the plastic bag (30). A method for making a reclosable plastic bag (30) is also disclosed.

7 Claims, 4 Drawing Sheets

ZIPPER WITH PRE-ACTIVATED PEEL-SEAL

CROSS REFERENCE TO RELATED APPLICATIONS

This is a continuation-in-part of U.S. patent application Ser. No. 09/969,736 filed on Oct. 3, 2001, now U.S. Pat. No. 6,595,690.

FIELD OF THE INVENTION

The present invention relates to a reclosable fastener assembly used in the manufacture of plastic bags. More specifically, the present invention relates to a reclosable fastener assembly including a zipper with a seal feature in which a peel-seal, tack seal or a temporary seal is made prior to attachment of the fastener assembly to the film used to make a plastic bag. Using a fastener assembly with a pre-made seal simplifies attachment of the fastener assembly to a bag film during the bag making process.

DESCRIPTION OF THE PRIOR ART

The present invention relates to improvements in the package making art and may be practiced in the manufacture of reclosable thermoplastic bags and packages of the kind that may be used for various consumer products. Such packages often include a form of peel-seal to render the pack moisture-tight and/or airtight prior to the initial opening and/or for use as a tamper-evident seal. A reclosable fastener or zipper protects any remainder of the product therein after the initial opening.

The use of peel-seals with reclosable fasteners or zippers in the package-making art is fairly well developed, but nevertheless remains open to improvements contributing to increased efficiency and cost-effectiveness during manufacture. Such peel seals are disclosed in U.S. Pat. Nos. 4,782,951; 4,786,190; 4,823,961; 4,925,316; 5,005,707; 5,014,856; 5,050,736; and 5,107,658. An improvement would be to provide a zipper with a seal feature in which a peel-seal, tack seal, or temporary seal is made prior to the application of the zipper to the film of a reclosable bag.

SUMMARY OF THE INVENTION

Accordingly, the present invention provides a new type of reclosable fastener assembly for use in the manufacture of plastic bags. The fastener assembly includes an extruded zipper and a seal feature on a longer of two web flanges extending away from opposite interlocking members of the zipper. A lower portion of the longer web flange is bent upward to the interlocking members. An interior face of the web flange is sealed to an opposite interior face of the web flange to form a peel-seal, tack seal, or temporary seal. When the seal is a peel seal, the peel seal in concert with the bend of the web acts as a barrier and a tamper-evident feature. At the bend, the web flange has a weakened cross-section in relation to the rest of the web flange. The cross-section at the weakness area may be thin enough to be torn open by the consumer to access the reclosable bag after the peel-seal is separated upon the first opening of the bag. The fastener assembly with pre-made seal can be attached to the film used to make a plastic bag during the bag making process.

DESCRIPTION OF THE DRAWINGS

Further objects and advantages of the invention will become apparent from the following description and claims and from the accompanying drawings, wherein:

DETAILED DESCRIPTION OF THE PREFERRED EMBODIMENT

Figure 1:
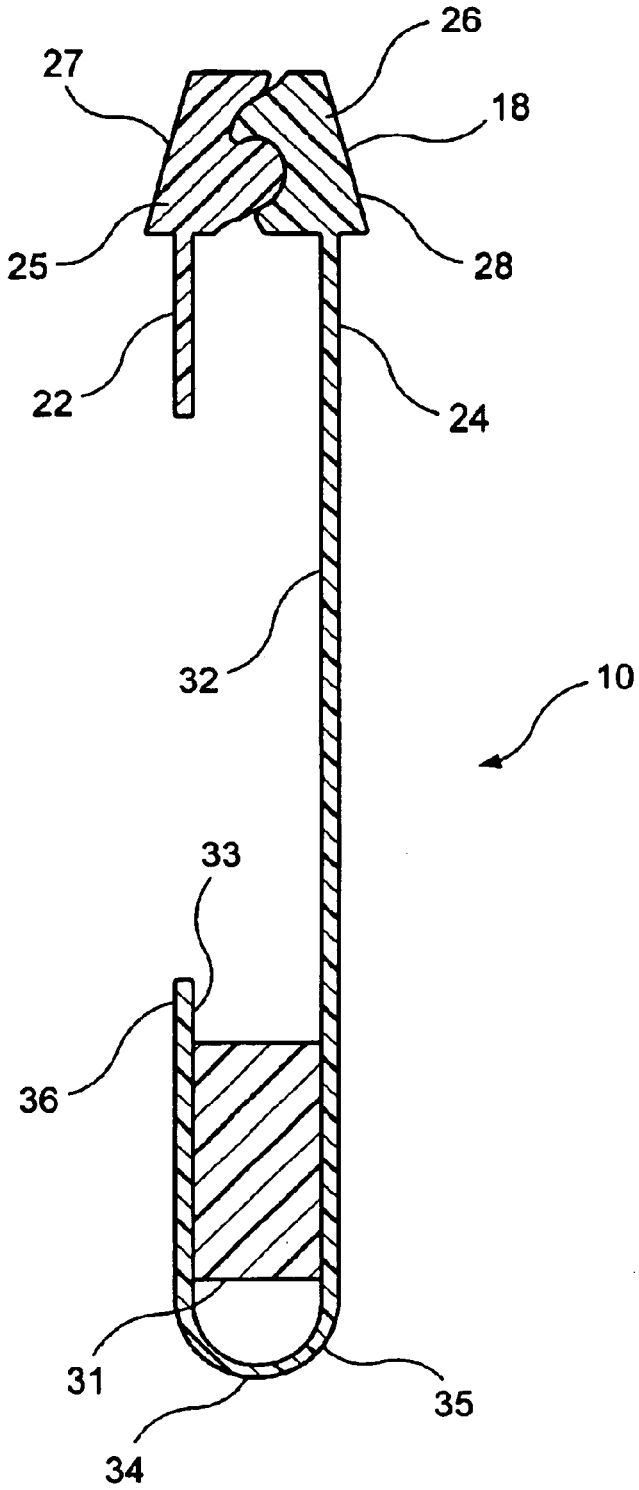
FIG. 1 is a cross-sectional view of the reclosable fastener assembly of the present invention (exaggerated in a horizontal direction for purposes of illustration)
Figure 3:
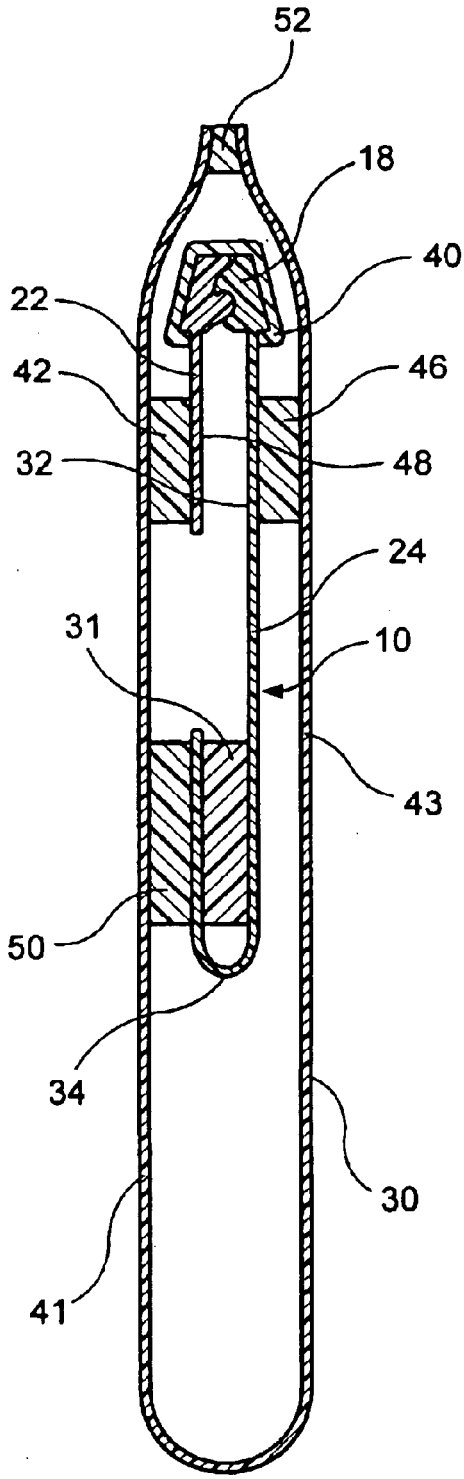
FIG. 3 is a cross-sectional view of the reclosable fastener assembly of the present invention (exaggerated in a horizontal direction for purposes of illustration) depicting the fastener assembly attached to a plastic bag with the zipper and the flange seal in a closed position and with the view taken from reference line 3—3 of FIG. 2.
Figure 4:
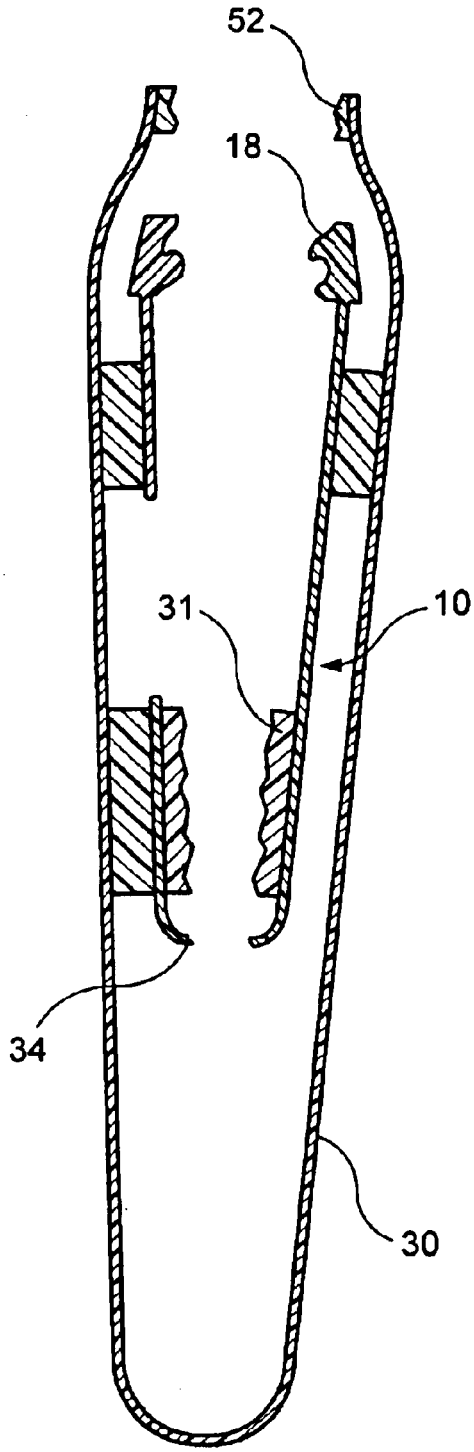
FIG. 4 is a cross-sectional view of the reclosable fastener assembly of the present invention (exaggerated in a horizontal direction for purposes of illustration) depicting the fastener assembly attached to a plastic bag with the zipper and the flange seal in an opened position.

Referring now to the drawings in detail wherein like numerals indicate like elements throughout the several views, a reclosable fastener assembly 10 of the present invention is shown in FIG. 1. In the cross-sectional view of FIG. 1, an extruded zipper 18 of the type known in the prior art is shown in an interlocking position. Other interlocking fasteners known to those skilled in the art may be used in lieu of the interlock shown, and the zipper may be provided with or without a slider. The zipper 18 as part of the present invention includes two extending web flanges 22 and 24, which are respectively connected to interlocking members 25 and 26 of profiles 27 and 28 of the zipper. The web flange 22 and the significantly longer web flange 24 are used to attach the fastener assembly 10 to a film forming the walls of a plastic bag 30 (as shown in FIGS. 2, 3 and 4).

Prior to attachment of the fastener assembly 10 to the bag film during a bag manufacturing process, the longer web flange 24 is bent and sealed to itself with flange seal 31 joining interior faces 32 and 33. The web flange 24 is bent upward at a weakness area 34 to form a bend 35, with a free end 36 of the bend facing the interlocking members 25 and 26 of the zipper 18. The flange seal 31 may comprise peel-seal material printed on either or both interior faces, or the peel-seal may be formed by any other conventional method known to those skilled in the art. Alternatively, the flange seal 31 may comprise sealing material which forms a tack or temporary seal area. Such sealing material for forming a tack seal would be known to those skilled in the art.

The weakness area 34 may comprise a partial score line or a line of perforations or a thinned cross-section of a portion of flange 24. The weakness area 34 and the flange seal 31 can be readily separated by a consumer when the plastic bag 30 is initially opened, allowing access to the contents of the bag. Thereafter the consumer can reclose the bag using the zipper.

Figure 2:
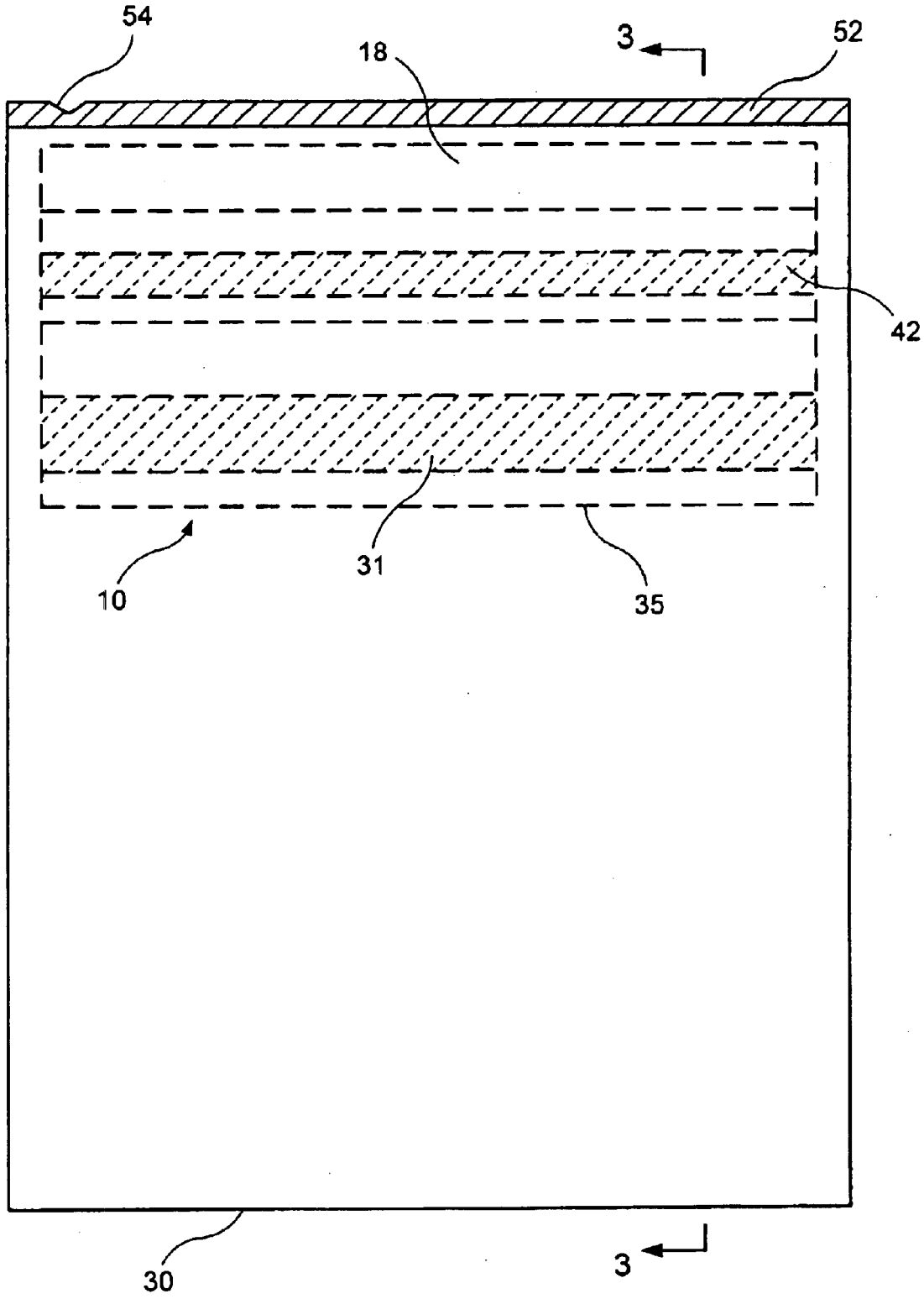
FIG. 2 is a front view of a reclosable fastener assembly of the present invention depicting the fastener assembly attached to a plastic bag.

In FIG. 2, the fastener assembly 10 is shown attached to the film used to form the bag 30. In the cross-sectional view of FIG. 3, the web flange 22 of the fastener assembly 10 (with a slider 40 shown) is sealed to a film wall 41 at a first seal 42. The first seal 42, and including other seals described in the specification, may be accomplished by conventional heat-sealing with a seal bar or by any other sealing process known to those skilled in the art.

The web flange 24 seals to an opposite film wall 43 of the bag at a second seal 46, which is generally aligned with seal 42 and positioned above the flange seal 31. The interior face 32 of the web flange 24 and an interior face 48 of the web flange 22 may be a heat-resistant material or a heat-resistant coating to prevent the interior faces 32 and 48 from being sealed together when the seals 42 and 46 are formed.

The web flange 24 also seals to the film wall 41 at a third seal 50, with the third seal disposed between the first seal 42 and the bend of the web flange 24. The seals 46 and 50, in combination with the film of the bag 30, permit a leakproof and hermetic sealing of the contents of the bag. The tops of the film walls 41 and 43 may be sealed at a fourth seal 52 above the zipper, which protects the zipper 18 and forms a coherent package. The fourth seal 52 is provided with a tear notch 54, shown in FIG. 2, to facilitate opening the fourth seal by a consumer upon the initial opening of the bag.

In FIG. 4, the reclosable fastener assembly 10 is shown in an opened position with the slider 40 not shown for illustrative purposes. As shown in the figure, after the fourth seal 52 and the zipper 18 are opened, the consumer is provided access to the flange seal 31. Once the flange seal 31 and the weakness area 34 are torn apart, the user can gain access to the contents of the bag 30.

Thus, the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A reclosable fastener assembly comprising:

a first profile having a first interlocking member and a first flange extending away from said first interlocking member;

a second profile having a second interlocking member interlockable with said first interlocking member;

a second flange extending away from said second interlocking member, said second flange including a free end and a bend directing said free end toward said second interlocking member; and a flange seal disposed between the free end and the bend joining facing portions of said second flange to each other.

2. The reclosable fastener in accordance with claim 1, wherein said flange seal is a peel seal.

3. The reclosable fastener assembly in accordance with claim 2, wherein said second flange further comprises a weakness area between the peel-seal and the bend.

4. The reclosable fastener assembly in accordance with claim 3, wherein said weakness area is a score line.

5. The reclosable fastener assembly in accordance with claim 3, wherein said weakness area is a line of perforations.

6. The reclosable fastener assembly in accordance with claim 3, wherein said weakness area is a thinned cross-section of said second flange.

7. The reclosable fastener assembly in accordance with claim 2, wherein said second flange is longer than said first flange.

* * * * *